United States Patent [19]

Spengler et al.

[11] Patent Number: 4,606,477

[45] Date of Patent: Aug. 19, 1986

[54] PORTABLE PRESSURE SPRAYER

[75] Inventors: William E. Spengler, Toledo; William C. Ramsey, Bryan, both of Ohio

[73] Assignee: Tolco Corporation, Toledo, Ohio

[21] Appl. No.: 724,534

[22] Filed: Apr. 18, 1985

Related U.S. Application Data

[62] Division of Ser. No. 514,510, Jul. 18, 1983, Pat. No. 4,537,334.

[51] Int. Cl.[4] ..... B67B 5/00

[52] U.S. Cl. ..... 222/153; 222/400.8; 222/474

[58] Field of Search ..... 222/401, 402, 402.15, 222/402.1, 400.2, 400.8, 209, 210, 470, 472, 473, 474, 505, 509, 383–385, 394, 153; 239/373

[56] References Cited

U.S. PATENT DOCUMENTS 1,112,202 9/1914 Estes ..... 222/402

2,111,961 3/1938 Brandt ..... 222/402

*Primary Examiner*—Joseph J. Rolla

*Assistant Examiner*—Kenneth Noland

*Attorney, Agent, or Firm*—Hugh Adam Kirk

[57] ABSTRACT

The disclosure concerns a reinforced plastic bottle or vessel with a relatively large neck with buttressed threads and bevelled rim on its neck onto which threads is screwed a cap assembly. This cap assembly comprises a plastic cap base member having a pair of parallel ribs forming a channel between an integral handle and a nozzle connection, a plastic manual air pump, a plastic siphon, a valve and spray nozzle assembly, and a lever disposed in said channel to operate the valve. The air pump is supported by an integral flange and depends vertically from the cap base member into the bottle with a disc-type checkvalve at its bottom. This air pump is attached to the cap base by a piston-guiding cap having a pair of diametrically opposite resilient hooks that snap into slots in parallel walls of said channel in the cap base member on each side of the piston-guiding cap. Also depending from the cap base member is a plastic siphon tube with a plastic screen at its lower end, and the upper end of this siphon tube is connected to a fluid duct in the nozzle connection. An L-shape first class lever extends from the handle in said channel to a point above the nozzle connection and has a depending forked arm for operating a tubular valve slidably mounted in the nozzle connection through which tubular valve the spraying fluid is conducted.

34 Claims, 7 Drawing Figures

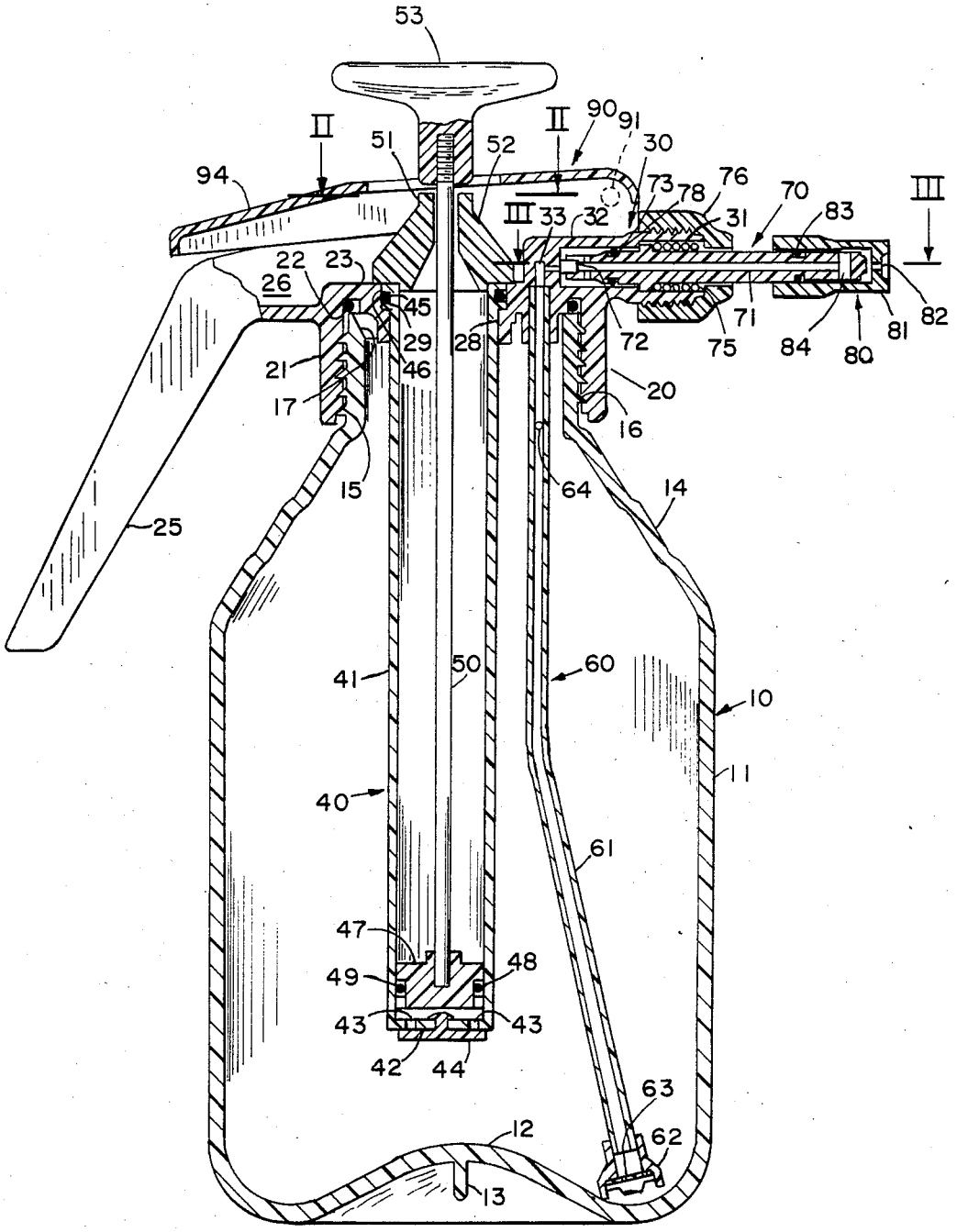
Fig I

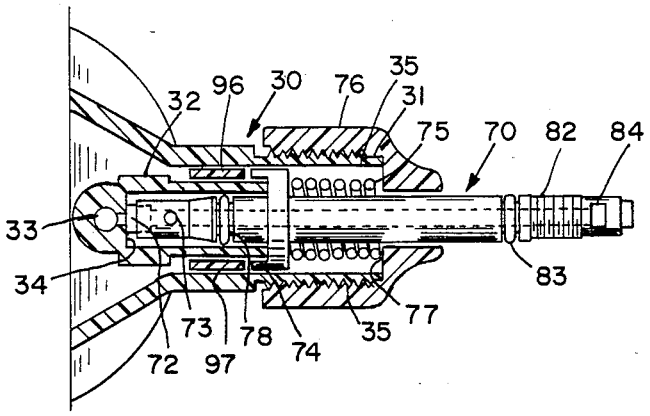
Fig III
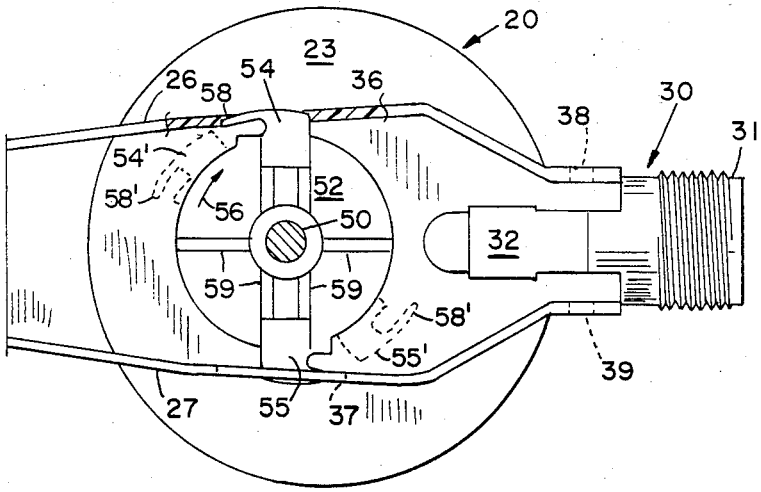
Fig II

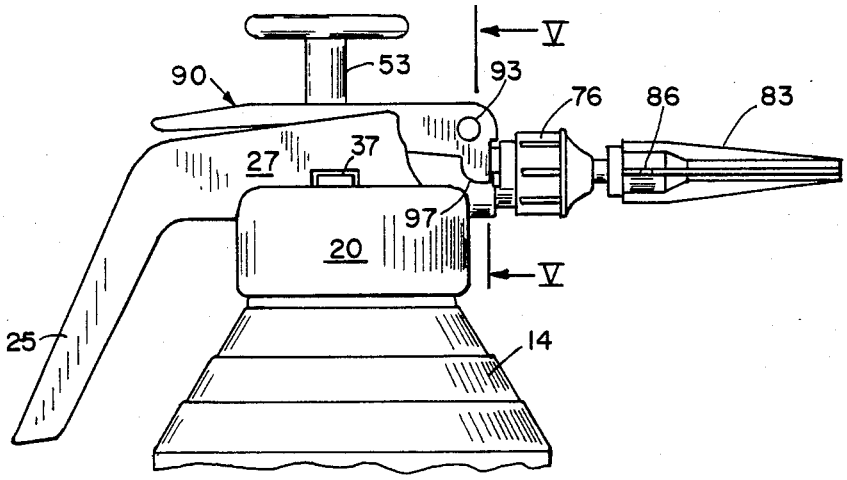
Fig IV
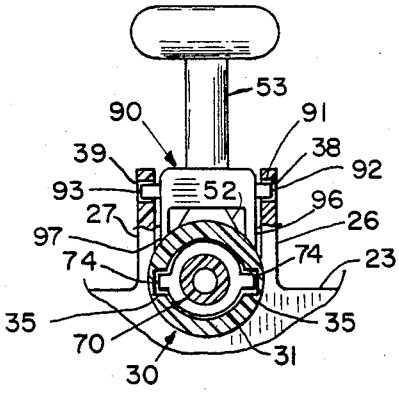
Fig V

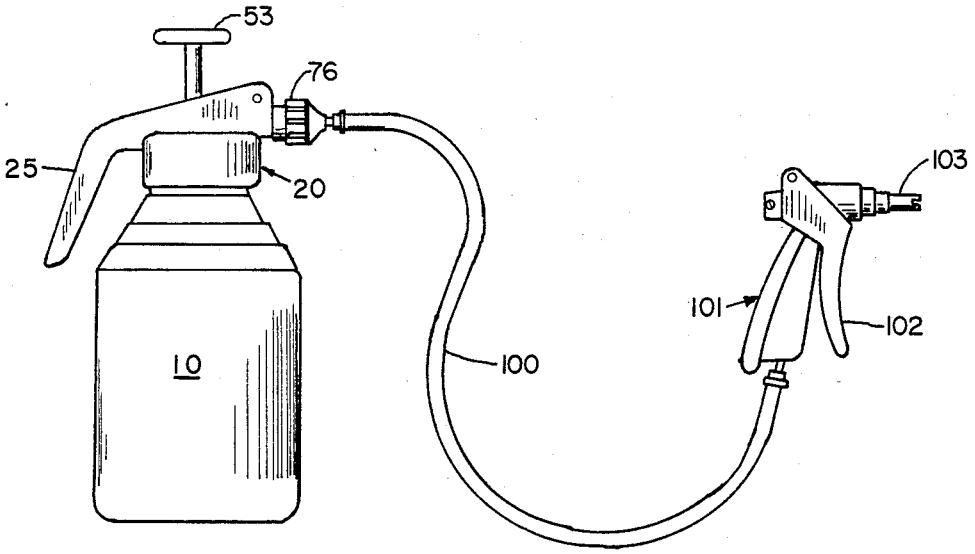
Fig VI
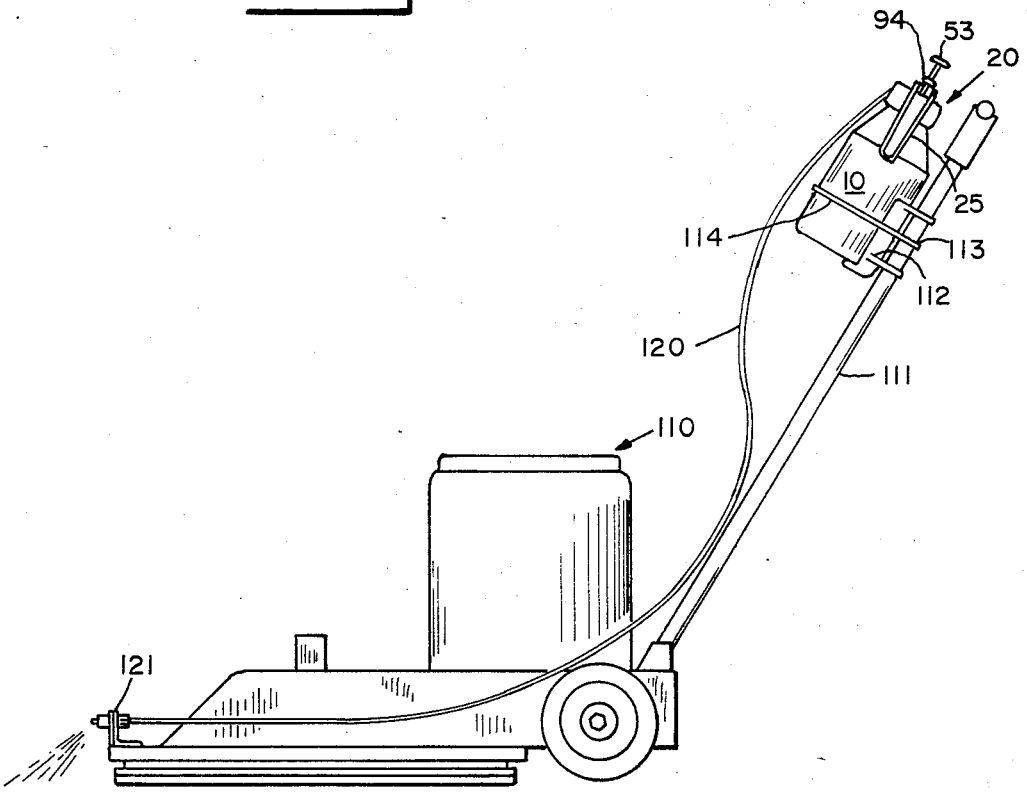
Fig VII

PORTABLE PRESSURE SPRAYER

This is a divisional of co-pending application Ser. No. 514,510 filed on July 18, 1983 now U.S. Pat. No. 4,537,334.

BACKGROUND OF THE INVENTION

Portable pressure sprayers with self-contained pressurizing pump means are well known in the art. However, previously all these known sprayers had one or more of the following disadvantages, namely: the liquids dispensed corroded their metal parts, it took too long to pressurize their containers, the containers were relatively heavy to carry, their caps and/or containers cracked or leaked under pressure, they were too complicated and expensive having too many parts, they were difficult to repair and/or assemble, and they were not easily adapted for other uses or applications.

SUMMARY OF THE INVENTION

Generally speaking, the improved portable pressure sprayer of this invention is composed substantially of plastic materials which do not corrode when exposed or contacted by the fluid spray, and if any metal parts are employed, they are maintained out of contact with such fluids. The parts of the sprayer comprise generally a container and a cap assembly comprising the sprayer mechanism.

The container is generally a cylindrical plastic bottle or vessel with a reinforcing rib across it concave bottom and has a relatively large neck with exterior buttressed threads. The top edge or rim of the neck is inwardly bevelled to seat a sealing O-ring.

The cap assembly for closing the container comprises a plastic cap base member, a vertical manually reciprocal air pump, a siphon, a valve and nozzle assembly, and a valve-operating lever.

The cap base member has a screw cap portion, an integral handle on one side thereof and a valve and nozzle connection on the other, and a central shouldered aperture flanked by two relatively parallel walls extending from the handle to the nozzle connection.

The vertically reciprocating hand pump is suspended in the container from the central aperture by its cylindrical housing having outwardly extending flange sealed by an O-ring against the shoulder in the aperture. This pump has as its lower end a disc-like rubber checkvalve, and has a checkvalve-operating piston. The piston rod connected to the piston extends loosely through a guiding aperture in a cap for the pump cylinder, and at the upper end of the piston rod is an operating handle. This tube may be provided with a transverse aperture near its upper end, if a foam is to be produced by the nozzle of the sprayer.

The tubular valve and nozzle assembly which reciprocates longitudinally in the horizontal nozzle connection means is provided with a pair of diametrically oppositely outwardly extending hook type ears in a horizontal plane which fit into parallel grooves in the horizontal aperture of the nozzle-connecting means. The outer side of these ears are urged by a helical spring surrounding the tubular valve, which spring is held in place by a screw cap around the projecting part of the nozzle connecting means for maintaining the tubular valve seated against the duct connected to the siphon tube. A sealing O-ring is provided around the tubular valve means on the opposite side of the ears for sealing the nozzle-connecting means duct and valve seat from the metal spring. The outer end of the tubular valve means is provided with an adjustable nozzle which can be adjusted for producing a spray or a jet stream, or can be adapted with a foam producing nozzle, if a transverse air hole is not provided near the top of the siphon tube. Also this tubular valve means may be replaced with an extension tube and hose, or a hose may be provided on the end of the tubular valve instead of the nozzle and have a nozzle at a remote location.

Pivoted above the valve means by trunnions in the parallel walls of the integral cap base is an L-shaped first class lever which extends across the top of the cap base from the ears of the tubular valve means to the top of the handle means so that the holder of the pressure container by means of his thumb can press down on that end of the lever to urge the opposite end against the ears of the tubular valve means to open the valve and operate the spray or cause injection of liquid from the container under the pressure previously produced in the container by the manual air pump means.

OBJECTS AND ADVANTAGES

Accordingly, it is an object of this invention to produce an efficient, effective, economic and simple portable pressure sprayer.

Another object is to produce such a sprayer which is non-corrosive to the liquids being sprayed, is lightweight, and is easy to assemble, disassemble and adjust.

Another object is to produce such a sprayer which may be quickly and easily pressurized, quickly and easily filled with liquid, quickly and easily adjusted, produce different types of sprays, and quickly and easily adapted and connected to hose extensions for a remote spray nozzle.

Still another object is to produce such a pressure sprayer which resists relatively high pressures, does not leak, does not crack, and does not separate its parts.

BRIEF DESCRIPTION OF THE VIEWS

The above mentioned and other features, objects and advantages, and a manner of attaining them are described more specifically below by reference to embodiments of this invention shown in the accompanying drawings, wherein:

FIG. I is a vertical sectional view of a preferred embodiment of the portable pressure sprayer according to this invention;

FIG. II is an enlarged plan sectional view taken along line II—II of FIG. I showing the resilient hook means for snap anchoring the pump in the cap for the vessel and showing the hook means in dotted lines in their pre-assembled position;

FIG. III is an enlarged sectional view taken along line III—III of FIG. I showing the nozzle-connecting means and tubular valve in closed position therein;

FIG. IV is a side elevational view of the upper end of the pressure vessel shown in FIG. I with parts broken away to show the L-shaped valve-operating lever and to have a foam-producing nozzle in place of the spray nozzle shown in FIG. I;

FIG. V is an enlarged sectional view taken along line V—V of FIG. IV showing the trunnion pivot for the L-shaped lever and its cooperation with the ears on the tubular valve means and the grooves to guide the ears in the nozzle-connecting means;

FIG. VI is a reduced side elevation of the pressure sprayer of this invention with an extension hose and remote spray valve mechanism connected to its nozzle connecting means; and FIG. VII is a side elevation of a floor polisher or buffer with a pressure sprayer according to this invention connected to the handle thereof for easy operation by the operator and an extension hose to a sprayer remote therefrom mounted on the front of the frame of the polisher or buffer.

DETAILED DESCRIPTION OF THE PREFERRED EMBODIMENT

Generally speaking, the portable pressure sprayer of this invention comprises: (A) the plastic pressure vessel or container 10; (B) the plastic integral cap base member 20 with handle and nozzel-connecting means; (C) the manual air pump 40; (D) the siphon 60; (E) the valve and nozzle means 70 and 80, respectively, and (F) the pivoted lever 90. These parts will first be described in separate sections according to the above capital letters and then the operation, and finally some adaptations of sprayer will be described in relation to FIGS. VI and VII.

A. The Pressure Container

Referring to FIG. I, a vertical section of the plastic pressure container 10 is shown herein to have cylindrical sides 11, a concave bottom 12 with an integral diametrically extending reinforcing rib 13, a stepped frusto-conical upper portion 14 ending in a relatively large diameter cylindrical neck portion 15 having external cut buttressed threads 16, and an inwardly bevelled upper edge on rim 17.

B. The Cap Base Member

The integral cap base 20, shown best also in FIG. I, comprises a cylindrical cap section 21 internally threaded for mating with the buttressed threads 16 on the neck 15 of the vessel 10. The upper inner end of this cylindrical section is provided with an O-ring 22 which seals against the bevelled rim 17 of the vessel and against the circular flat substantially annular top 23 of this base member 20. Extending radially out of one side of this cylindrical cap section 21 is an outwardly and downwardly extending handle portion 25 which may parallel the surface of the frusto-conical section 14 of the pressure vessel 10 but is spaced sufficiently therefrom for an operator to place easily his hand in between the handle 25 and the vessel surface 14. The side walls of the U-shaped cross-section of this handle 25 extend integrally into two substantially parallel wall portions 26 and 27, shown best in FIG. II, surrounding a centrally located aperture 28 in the top 23 having a shoulder 29 as shown in FIG. I. Diametrically opposite the handle 25 is integrally formed the valve seat and nozzle-connecting means 30 which comprises a radially outwardly threaded boss portion 31 having an internal aperture with diametrically opposite extending parallel grooves 35 (see FIGS. III and V). This aperture is aligned with an aperture in boss portion 32 connected to an L-shaped duct 33. The radial outwardly end of this duct 33 provides a seat 34 for a tubular valve means 70 to be described in Section D later. The two wall portions 26 and 27 diametrically opposite the center aperture 28 in the top surface 23 of this cap base are provided a pair of slots 36 and 37, respectively (see FIGS. II and IV). Also these parallel wall portions 26 and 27 have horizontally aligned apertures 38 and 39 above the valve and nozzle connections means 30 for journalling the pivot for the lever handle 90 (see FIGS. II and V).

C. The Manual Air Pump

Referring again to FIG. I there is disclosed in section, the pump 40 supported by the shoulder 29 in the cap top 23, which pump 40 comprises a hollow cylindrical housing 41 which depends into the vessel 10 and has lower end 42 having one or more apertures 43 therein which are normally closed by a snap-in rubber disc 44 which closes the apertures 43 and acts as a checkvalve to maintain the apertures 43 closed under the pressure inside the vessel 10, even if the rubber 44 may deteriorate some by the liquid contained in the vessel. The upper end of the cylindrical housing 41 has an outwardly extending peripherally grooved flange 45, in whcih groove is placed an O-ring 46 to seal the pump housing to the cap base member 20. Vertically reciprocable in the housing 41 is a piston 47 having a peripheral groove 48 for loosely supporting an O-ring 49 which acts as a checkvalve to bypass air on its upward stroke, and to compress the by-passed air on its downward stroke to open the disc checkvalve 44 at the bottom of the cylinder 41 to pressurize the vessel 10. The piston 47 is connected to a vertical piston rod 50 which extends up through a loose opening 51 in the upper pump cylinder cap member 52, and the outer upper end of the rod 50 is anchored into a plastic handle 53 extending above the top of the cap assembly.

Referring now to FIG. II this cylinder cap member 52 is shown to have two diametrically opposite radially extending flexible or resilient hooks 54 and 55 which, when the assembly 52 is rotated in the direction of the arrow 56, snap the flexible ends 58 of these hooks into the slots 36 and 37, respectively. These radially extending hooks or projections 54 and 55 not only retain the cap 52 from being blown out of the top of the cap base member 20 by pressure inside the vessel 10, but they also by their flexible hook ends 58, which extend tangentially from the outer peripheral ends of the extensions 54 and 55, snap and lock into position in the slots 36 and 37 so that the cylinder cap 52 can not be removed by counter rotation to that of the arrow 56 without the employment of a special tool to flex inwardly the hook ends 58. These hooks and ends are shown in their dotted line positions 54', 55', and 58' before they are rotated and snapped into their locking positions shown in full lines in FIG. II. This pump cylinder cap member 52 is herein shown to be made of a conical piece of plastic with reinforcing radially extending ribs 59 so as to withstand relatively high pressure that can be produced by the hand pump 40 inside of the vessel 10. The full height of the wall portions 26 and 27 at which the slots 36 and 37 are at the bottom, maintain the cylinder cap in position by engagement of substantially all of the hooks 54 and 55.

D. The Siphon

Referring again to FIG. 1, there is disclosed a siphon assembly 60 comprising a plastic tube 61 which may have a bend near its center so that its lower end will extend to the lower peripheral annular trough in the bottom 12 of the vessel 10. This lower end is fitted with a castellated bottom member 62 which contains a plastic screen 63. The upper end of the tube 61 fits into the depending portion of the L-duct 33 in the valve and nozzle connecting means 30 of the cap base 20. There may be provided, if desired, a transverse or radial hole 64 in the side of tube 61 near its upper end communicating with the air space above the liquid normally in the vessel 10 so that air will also be mixed with the liquid that is forced up through the tube 61 by pressure in the vessel, to produce a foam of the liquids as it is ejected from the nozzle member assembly 70.

E. The Valve and Nozzle Means

Referring primarily to FIGS. I and II, reciprocating valve means 70 comprises a hollow tube or tubular valve means 71, the inner end of which is provided with a gasket 72 which seats against the open end 34 of the horizontal portion of the L-duct 33 to close off the liquid from the siphon 60. Adjacent the gasket 72 there are provided transverse apertures or ducts 73 to the central hollow portion of the valve tube 71 so that the duct in the center of the tubular valve 71 is in communication with the chamber surrounding the inner end of the tubular valve 71. The inlet to this chamber is at the end of the horizontal portion of the L-duct 33 and this inlet is normally closed by the gasket 72. The tubular valve means 71 is provided with a horizontal radially oppositely extending projections or hook means 74 which slide in the grooves 35 of the portion 31 (see FIGS. III and V). Urged against the forward outer side edges of this projection 74 is a helical compression spring 75 that surrounds the outside of the tubular valve means 71, which spring is compressed at its other outer end by an inwardly extending flange 77 on the outer end of an internally threaded bushing 76. Thus the tubular valve means 71 is normally seated to close the open end of the L-duct 33. The threaded bushing 76 enables the easy disassembly of the nozzle and valve assembly in the event it gets clogged or in the event it is to be removed or changed to another mechanism adapted or placed therein. To seal the spring 75 from any liquid from the vessel 10, there is provided an O-ring 78 around and in a circumferential groove in the tubular valve means 71 between the outwardly projecting hook means 74 and the apertures 73, thus sealing the chamber in the valve and nozzle connecting means 32 of the top cap base 20.

At the outer end of the tubular valve means 71 there is provided a nozzle member 80 which, as shown in FIG. I, comprises a cylindrical cap 81 with an aperture 82 at the center of its outer otherwise closed end. Internal threads along the central interior of this cap 81 engage the external threads 82 near the outer end of the tubular valve 71 behind which threads is provided a circumferential groove containing an O-ring 83 for sealing any liquid from leaking out from the open inner end of the screw-on nozzle member 80 on its cap 81. The outer end of the tubular valve member 71 is blocked adjacent the aperture 82 but behind this end there is provided transverse ducts 84 so that the liquid being ejected or sprayed can pass through the chamber in the nozzle cap 81 before leaving the end outlet 82. Rotation of this screw-adjustable nozzle cap 81 on the outer end of the tubular valve 71 varies the distance of its aperture 82 from the blocked end of the tubular valve 71, to produce a fine spray or a jet stream or any pattern spray in between as well as vary the amount of liquid which can pass through the aperture 82 in a given time. Also if desired, and no hole 64 is provided or placed in the siphon tube 61, the nozzle cap 81 may be replaced by a foam producing nozzle 85 as shown in FIG. IV, which nozzle has air intake holes 86 therein near its base for adding air to the liquid to produce the foam desired.

F. The Lever

The lever means 90 for operating the valve 70 is shown in FIGS. I, III, IV and V, and is an L-shaped first class lever with its pivot 91 at the angle portion of the "L" above the inner end of the valve 31. This pivot 91 comprises, as shown in FIG. V, a pair of outwardly extending trunnions 92 and 93 which are journalled in the apertures 38 and 39 of the wall portions 26 and 27, repsectively, of the cap base member 20. These trunnions 92 and 93 may have their outer ends bevelled or slanted, (see FIG. V), so as to be easily wedged into their journally apertures 38 and 39 by flexing of the outer upper edges of the wall portions 26 and 27. The elongated horizontal portion 94 of the lever 90 extends to adjacent the upper end of the handle 25 so that it can be easily contacted and depressed by the thumb of the operator holding the handle 25 of the sprayer. Depression of this lever end 94 in turn rotates the lever 90 around its fulcrum on pivot 91 on its integral trunnions 92 and 93 to push outwardly from the vessel the depending forked lever ends 96 and 97 of the lever means 90. These forked ends 96 and 97 extend down on opposite sides of the housing portion 32 for the valve means 71 and press against the inner edges of the projections or hook means 74 of the tubular valve means 71 to compress the spring 75 and simultaneously open the valve by removing the gasket 72 from the outer end of the horizontal section of duct 33 to permit liquid to pass through the duct in the tubular valve means and out through the nozzle 80.

G. The Operation

The operation of the portable sprayer is usually commenced by unscrewing the cap assembly 20 with the pump 40 and siphon 60 depending therefrom and the valve and nozzle means 70 and 80 and lever 90 all installed thereon. Once the vessel 10 is open, the liquid to be dispersed is quickly and easily poured into the wide neck 15 of the container 10 and filled to below the neck, preferably just to the upper end of the cylindrical section 11 so as to provide adequate space for compressed air above the liquid and for expansion and pushing out of the liquid without having to recompress the bottle vessel 10 too frequently. The cap is then screwed onto the container by the insertion of the pump 40 and siphon 60 into the liquid in the container, which of course raises the liquid level some by their insertion into and displacement of the liquid therein. The buttressed threads 16 are so arranged that any pressure built up in the vessel 10 forces against the flat positive lower sides of the threads and thus these threads resist expansion of the cap base 20 or contraction of the neck 15 to cause leakage therebetween.

After the cap assembly is screwed on tightly so that the upper bevelled edge 17 of the neck 15 engages the O-ring 22 to form a fluid-tight seal with the cap base 20, the handle 53 of the pump 40 is raised and lowered a sufficient number of times to build up pressure inside the vessel 10, as air pressure above the level of the liquid in the vessel 10. This usually can be done with a dozen stokes or less.

Now the vessel is ready to be used by lifting the sprayer by the handle 25 and pointing it in the direction to which a spray is to be ejected, the thumb of the operator carrying the vessel is pressed downwardly on the lever arm 94 and immediately a spray of the liquid in the vessel or container 10 is ejected through the aperture 82 at the end of the nozzle 80. If the stream from this aperture is not of the right type, the nozzle 80 can readily be adjusted to produce the proper spray. If a transverse hole 64 is not in the siphon tube, and usually it is not, a separate foam-type nozzle 85 as shown in FIG. V may be placed on the threaded outer end of the tubular valve means 71 to replace the nozzle 80 as shown in FIG. I.

H. Some Adaptions

Referring now to FIGS. VI and VII, these show how the pressure sprayer described above in FIGS. I through V can be adapted for other uses. For example the tubular valve and nozzle means 70 can be removed therefrom by unscrewing the cap or bushing 76 and removing the tubular valve means 71, and replacing it with a tube with open ends to which a hose 100 as shown in FIG. VI may be attached. The outer end of this hose 100 then may be connected to a spray gun assembly 101, which may contain its own valve mechanism and manually operated valve lever means 102, and have its own spray nozzle 103.

Furthermore, if desired, the portable pressure sprayer may be attached to a polisher or floor buffing machine 110 as shown in FIG. VII, by being clamped to the handle 111 thereof by means of a special supporting bracked 112, which may be fastened to the handle 111 by a strap type hose clamp 113, and the vessel 10 may be clamped to the bracket 112 by means of a strap 114, such as of Velcro. This bracket 112 herein is shown to be partially cylindrical for setting and holding part of the bottom and part of the side of the vessel 10. The handle 25 and its lever 94 is sufficiently adjacent the handle 115 of the polisher 110 so that the operator can reach it easily to press the lever 94 and open the valve means 70. Connected to this tubular valve is an extension hose 120 that extends down to a nozzle 121 mounted on the front end of the buffing machine 110 for spraying wax or other coating liquid onto the floor which is to be polished by the polisher 110.

It is to be understood that the shapes of the vessel 10 and of the parts disclosed, as well as the adapting devices and nozzles may be changed without departing from the scope of this invention. While the rigid plastic parts shown herein are preferrably made of a high density polyethylene, and the flexible plastic materials may be made of a buna-type chemical resisting rubber, other plastic materials having similar physical and chemical resistant properties may be used. Thus, while there is described above the principles of this invention in connection with specific apparatus, it is to be clearly understood that this description is made only by way of example and not as a limitation to the scope of this invention.

We claim:

1. A portable pressure sprayer comprising:

(A) a reinforced plastic container with a neck, (B) a plastic cap means threaded on said neck having an integral handle, a nozzle connecting means, and a pair of parallel ribs forming a channel between said handle and said nozzle connecting means, (C) a manually operated pump means supported by said cap means including means for snap-locking said pump means in said channel to said cap means comprising diametrically opposite resilient hooks on said pump means which snap lock into opposing slots in said pair of parallel ribs.

(D) a plastic siphon tube depending from said cap means into said container, and being in fluid communication with said nozzle connecting means, (E) a nozzle means connectable to said nozzle connecting means and having a normally resiliently closed valve means, and (F) a lever means in said channel adjacent said integral handle for operating said valve means.

2. A sprayer according to claim 1 wherein said reinforced plastic container comprises a diametric rib across the indented bottom of said container.

3. A sprayer according to claim 1 wherein said neck of said reinforced container has cut threads.

4. A sprayer according to claim 3 wherein said cut threaded neck has buttressed threads.

5. A sprayer according to claim 1 wherein said reinforced container neck has a top bevelled edge.

6. A sprayer according to claim 5 wherein said top bevelled edge of said neck is inwardly tapered.

7. A sprayer according to claim 6 wherein said plastic cap includes an O-ring seatable on said bevelled edge.

8. A sprayer according to claim 1 wherein said integral handle extends radially outwardly and downwardly on said cap means.

9. A sprayer according to claim 1 wherein said nozzle connecting means extends diametrically opposite from said integral handle on said cap means.

10. A sprayer according to claim 1 wherein said pump means comprises a cylinder and a piston in said cylinder.

11. A sprayer according to claim 10 wherein said cylinder depends through an aperture in said cap means and extends into said container.

12. A sprayer according to claim 10 wherein aid means for snap-locking comprises a cap for said cylinder and guide for said piston.

13. A sprayer according to claim 12 wherein said piston comprises a rod having a check valve at its lower end and a handle at its upper end extending above said cap means.

14. A sprayer according to claim 13 wherein said piston handle is connected by threads to said rod.

15. A sprayer according to claim 12 wherein said cylinder has a check valve at its lower end.

16. A sprayer according to claim 15 wherein said check valve is disc-shaped and centrally suppored axially of said cylinder.

17. A sprayer according to claim 1 wherein said pump means comprises a reciprocating air pump.

18. A sprayer according to claim 1 wherein said siphon tube has a filter at its lower end in said container.

19. A sprayer according to claim 1 wherein all of its parts contactable with the liquid to be sprayed are of polyethylene high-density plastic.

20. A sprayer according to claim 1 wherein said valve means is tubular.

21. A sprayer according to claim 20 including sealing means between said cap means and said container, said cap means and said pump means, and said cap means and said tubular valve means.

22. A sprayer according to claim 21 wherein said sealing means are composed of buna-type chemical resisting rubber.

23. A sprayer according to claim 20 wherein said tubular valve means has a seat at its inner end in said nozzle connecting means.

24. A sprayer according to claim 20 wherein said tubular valve means includes diametrically opposite outward projecting means for engagement with said lever means.

25. A sprayer according to claim 24 wherein said nozzle connecting means on said cap means includes substantially parallel grooves for said diametrically opposite outward projecting means.

26. A sprayer according to claim 24 wherein said resiliently closed tubular valve means comprises a helical spring surrounding said tubular valve between said outward projecting means and said nozzle means.

27. A sprayer according to claim 20 wherein said siphon tube communicates with the hollow tubular center of said valve means.

28. A sprayer according to claim 20 wherein said nozzle means includes a tubular extension between said tubular valve means and a spraying nozzle.

29. A sprayer according to claim 28 including means for clamping said container onto the handle of a floor-treating machine and mounting said spraying nozzle adjacent the floor-treating means of said machine.

30. A sprayer according to claim 1 wherein said parts that are in direct contact with the liquid to be sprayed are composed of chemical resistant plastic.

31. A sprayer according to claim 1 wherein said nozzle means includes a removable and adjustable nozzle on the outer end thereof.

32. A sprayer according to claim 1 wherein said lever means is an L-shaped first class lever.

33. A sprayer according to claim 1 wherein the pivot for said lever means comprises bevelled end trunnions journalled in parallel ribs on said cap means.

34. A sprayer according to claim 1 wherein said lever means has a hooked end for operating said valve means.

* * * * *

UNITED STATES PATENT AND TRADEMARK OFFICE

CERTIFICATE OF CORRECTION

PATENT NO. : 4,606,477

DATED : August 19, 1986

INVENTOR(S) : William E. Spengler et al

It is certified that error appears in the above-identified patent and that said Letters Patent are hereby corrected as shown below:

Column 1, line 31, change "it" to - - its - -
Column 1, line 48, change "as" to - - at - -
Column 1, between lines 52 and 53, insert the following:

- - The rod guiding cap for the pump cylinder is provided with a pair of diametrically opposite extending flexible hook means which snap into slots in the parallel walls of the integral cap for maintaining the pump in the cap base when the container is pressurized.

Also depending from the cap base is a plastic siphon tube with a plastic sieve at its lower end, which tube extends from the bottom of the container to a duct in the cap base to the nozzle-connecting means. - -

Column 3, line 15, change "nozzel" to - - nozzle - -

Claim 12, line 1, change "aid" to - - said - -

Signed and Sealed this

Eighteenth Day of November, 1986

*Attest:*

DONALD J. QUIGG

*Attesting Officer* *Commissioner of Patents and Trademarks*